US010859307B2

(12) United States Patent
Yi

(10) Patent No.: US 10,859,307 B2
(45) Date of Patent: Dec. 8, 2020

(54) REFRIGERATOR

(71) Applicant: LG ELECTRONICS INC., Seoul (KR)

(72) Inventor: Myeongha Yi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/575,910

(22) Filed: Sep. 19, 2019

(65) Prior Publication Data

US 2020/0011589 A1 Jan. 9, 2020

Related U.S. Application Data

(63) Continuation of application No. 15/513,238, filed as application No. PCT/KR2016/012931 on Nov. 10, 2016, now Pat. No. 10,451,332.

(30) Foreign Application Priority Data

Jan. 5, 2016 (KR) ..... 10-2016-0001281

(51) Int. Cl.
*F25D 23/02* (2006.01)
*E05D 5/06* (2006.01)
(Continued)

(52) U.S. Cl.
CPC ..... *F25D 23/028* (2013.01); *E05D 3/02* (2013.01); *E05D 5/06* (2013.01); *E05D 7/081* (2013.01);
(Continued)

(58) Field of Classification Search
CPC .. F25D 23/028; F25D 23/02; F25D 2323/021; F25D 2323/023;
(Continued)

(56) References Cited

U.S. PATENT DOCUMENTS 1,078,703 A 11/1913 Soss
1,772,559 A 8/1930 Soss
(Continued)

FOREIGN PATENT DOCUMENTS

CN 1208167 2/1999
CN 102257339 11/2011
(Continued)

OTHER PUBLICATIONS

Supplementary European Search Report in European Application No. 16847607.5, dated Aug. 21, 2018.
(Continued)

*Primary Examiner* — Hanh V Tran
(74) *Attorney, Agent, or Firm* — KED & Associates, LLP

(57) ABSTRACT

A refrigerator includes a body defining a storage compartment therein, a first door hingedly provided at the body so as to open and close the storage compartment, the first door including a door frame having a hinge hole formed therein, and a second door hingedly provided at the first door by means of a hinge, the second door including a lateral side surface, the lateral side surface being at least partially fitted into the door frame, wherein the hinge includes a hinge shaft disposed in the first door so as to define a rotational center of the second door, a hinge bracket coupled to the second door, and an indented member provided between the hinge shaft and the hinge bracket, the indented member being moved through the hinge hole so as to allow the entire second door to escape from the door frame when the second door is opened.

20 Claims, 10 Drawing Sheets

(51) Int. Cl.
*E05D 3/02* (2006.01)
*E05D 7/081* (2006.01)
*E05D 11/06* (2006.01)

(52) U.S. Cl.
CPC ..... *F25D 23/02* (2013.01); *E05D 11/06* (2013.01); *E05Y 2600/41* (2013.01); *E05Y 2800/71* (2013.01); *E05Y 2900/31* (2013.01); *F25D 2323/021* (2013.01); *F25D 2323/023* (2013.01); *F25D 2323/024* (2013.01)

(58) Field of Classification Search
CPC ..... F25D 2323/024; E05D 5/06; E05D 3/02; E05D 7/081; E05D 11/06; E05Y 2800/71; E05Y 2600/41; E05Y 2900/31
See application file for complete search history.

(56) References Cited

U.S. PATENT DOCUMENTS

| | | | | |
|---|---|---|---|---|
| 1,948,775 | A | 2/1934 | Teller | |
| 2,129,862 | A | 9/1938 | Naert | |
| 2,332,788 | A | 10/1943 | Flocks | |
| 4,609,234 | A | 9/1986 | Naniwa | |
| 9,441,872 | B2 | 9/2016 | Park | |
| 10,274,250 | B2 * | 4/2019 | Kim | F25D 23/025 |
| 10,280,673 | B2 * | 5/2019 | Shin | E05F 15/619 |
| 10,295,249 | B2 * | 5/2019 | Park | F25D 23/028 |
| 10,578,349 | B2 * | 3/2020 | Kim | B21D 5/00 |
| 2007/0256447 | A1 | 11/2007 | Leimkuehler | |
| 2010/0154457 | A1 | 6/2010 | Kim | |
| 2012/0043873 | A1 | 2/2012 | Jeon | |
| 2012/0062093 | A1 | 3/2012 | Lee | |
| 2013/0111941 | A1 | 5/2013 | Yu | |
| 2014/0285082 | A1 | 9/2014 | Choi | |
| 2015/0233629 | A1 | 8/2015 | Choi | |
| 2016/0061511 | A1 | 3/2016 | Park | |
| 2016/0123654 | A1 | 5/2016 | Lee | |
| 2016/0146529 | A1 | 5/2016 | Choi | |
| 2017/0030629 | A1 | 2/2017 | Nai | |
| 2018/0038637 | A1 | 2/2018 | Kim | |
| 2018/0112906 | A1 | 4/2018 | Yi | |
| 2018/0149420 | A1 | 5/2018 | Lee | |
| 2018/0223582 | A1 | 8/2018 | Shin | |
| 2018/0292127 | A1 | 10/2018 | Park | |

FOREIGN PATENT DOCUMENTS

| | | |
|---|---|---|
| CN | 104075534 | 10/2014 |
| GB | 2252789 | 8/1992 |
| GB | 2327977 | 2/1999 |
| JP | H11-063801 | 3/1999 |
| JP | 2003-021452 | 1/2003 |
| KR | 20-2000-0013278 | 7/2000 |
| KR | 10-2009-0085181 | 8/2009 |
| KR | 10-2010-0065904 | 6/2010 |
| KR | 10-2010-0070853 | 6/2010 |
| KR | 10-2014-0145925 | 12/2014 |
| KR | 10-2016-0045545 | 4/2016 |

OTHER PUBLICATIONS

Chinese Office Action in Chinese Application No. 201680005010, dated Mar. 5, 2019.

* cited by examiner

REFRIGERATOR

CROSS REFERENCE TO RELATED APPLICATIONS

This application is a Continuation of U.S. patent application Ser. No. 15/513,238, filed Mar. 22, 2017, which is a U.S. National Phase Application under 35 U.S.C. § 371 of International Application No. PCT/KR2016/012931 filed on Nov. 10, 2016, which claims the benefit of Korean Patent Application No. 10-2016-0001281, filed on Jan. 5, 2016, whose entire contents are hereby incorporated by reference.

TECHNICAL FIELD

The present invention relates to a refrigerator, and more particularly to a refrigerator including a dual door, which is convenient to use.

BACKGROUND ART

In general, a refrigerator is an apparatus for keeping foods frozen or at a temperature slightly above freezing by discharging cold air generated by a refrigeration cycle, realized using, for example, a compressor, a condenser, an expansion valve, and an evaporator, to lower the temperature in a storage compartment thereof.

A typical refrigerator includes a freezing compartment, in which foods or beverages are kept frozen, and a refrigerating compartment, in which foods or beverages are kept cold.

There are several kinds of refrigerators, including a top-mounting type refrigerator, in which a freezing compartment is located above a refrigerating compartment, a bottom-freezer type refrigerator, in which a freezing compartment is located below a refrigerating compartment, and a side-by-side type refrigerator, in which a freezing compartment and a refrigerating compartment are respectively located on left and right sides. The freezing compartment and the refrigerating compartment may be provided with respective doors, and may be accessed through the respective doors.

In addition to such refrigerators, which include a refrigerating compartment and a freezing compartment which are compartmentalized from each other, there is also a refrigerator which allows access to both the refrigerating compartment and the freezing compartment through a single door. This kind of refrigerator is mostly small-sized, and is typically constructed such that the freezing compartment is provided in a predetermined space within the refrigerating compartment.

Among the top-mounting refrigerators, there is also provided a French type refrigerator in which an upper refrigerating compartment is opened and closed by right and left doors. The freezing compartment of the French type refrigerator may also be opened and closed by right and left doors.

Recently, in addition to the original function of keeping foods refrigerated or frozen, the variety of functions provided by refrigerators is increasing. Specifically, a dispenser is installed to a door of the refrigerator so as to provide purified water and ice, and a display is installed on the front surface of the door so as to show the state of the refrigerator and to assist a user in controlling the refrigerator.

In recent years, a refrigerator in which only part of a storage compartment is separately openable has been proposed. Specifically, in addition to a main door for opening or closing a storage compartment, a refrigerator which is provided with a sub door for opening or closing a sub storage compartment defined in the main door has been proposed. The sub storage compartment is a portion of the space in the main storage compartment, and is isolated from the main storage compartment by a partition wall. This kind of refrigerator may be referred to as a door-in-door (DID) refrigerator or a dual-door refrigerator. This DID refrigerator is advantageous in that the outward leakage of cold air from the main storage compartment is considerably reduced when only the sub door is opened.

For example, stored objects, such as beverages, which are frequently taken out of and put back into the storage compartment, are stored in the sub storage compartment, and thus the sub storage compartment can be accessed by opening the sub door while maintaining the main door in the closed state.

This kind of DID refrigerator or dual-door refrigerator may be configured in such a manner that a sub door is embedded in a main door. In other words, the sub door is disposed so as to cover the front surface of the main door, and the main door has a front surface area that is substantially the same as that of the front surface of the sub door.

In this kind of DID refrigerator, the sum of the thickness of the main door and the thickness of the sub door may be the same as, for example, the thickness of a right refrigerating compartment door. Each of the main door and the sub door has a relatively small thickness.

The present applicant has proposed a refrigerator, which is provided with a DID door in which a sub door is embedded in a main door, in Korean Patent Application No. 10-2015-0088477 (hereinafter, referred to as "related patent"). An example of this kind of refrigerator is illustrated in FIG. 1.

As illustrated in FIG. 1, a right refrigerating compartment door 25 includes a main door 100, which is hingedly coupled to a body 10 and which has an opening 116 formed in the center region thereof, and a sub door 200, which is hingedly coupled to the main door 100 so as to be fitted into the main door 100. A sub storage compartment opening 115 may be provided inside the opening 116 so as to allow a user to access a sub storage compartment provided behind the main door 100. In the related patent, the sub storage compartment opening 115 may be configured to define a window, which allows the storage compartment to be visible from the outside.

The sub door 200 is configured to be smaller than the main door 100, and is fitted in the opening 116 of the main door 100 when the sub door 200 is closed. Specifically, at least part of the anteroposterior thickness of the sub door 200 is accommodated in the main door 100. In other words, at least part of the side surface of the sub door 200 is fitted into the opening 116 in the main door 100. The front surface of the sub door 200 may be preferably flush with the front surface of the main door 100 (specifically, the front surface of the portion of the main door 100 that surrounds the sub door 200).

Accordingly, the refrigerator illustrated in FIG. 1 may be considered as a refrigerator in which the sub door 200 is fitted into the main door 100 so as to close the opening 116 of the main door 100 in the state in which the main door 100 is closed. This refrigerator may be referred to as an inside-type DID refrigerator or an inside-type dual-door refrigerator. Meanwhile, a conventional general refrigerator, which has been described above, may be referred to as an outside-type DID refrigerator or an outside-type dual refrigerator.

In the inside-type DID refrigerator illustrated in FIG. 1, since the sub door 200 is embedded in the main door 100, the thickness of the sub door 200 may be further increased compared to the outside-type DID refrigerator. In other words, increasing in the thickness of a thermal insulation wall means reducing the loss of cold air.

However, since part of the sub door 200 is always fitted in the main door 100 even when the sub door 200 is opened, a problem occurs in that it is difficult to open the sub door 200 to an angle exceeding 90 degrees. The reason for this is because interference between the main door 100 and the sub door 200 occurs when the sub door 200 is opened beyond 90 degrees.

Furthermore, the refrigerator disclosed in the related patent enables the inside of the storage compartment 11 to be visible from the outside through the sub door 200. Specifically, the refrigerator enables the storage compartment 11 to be visible without having to open the sub door 200 from the outside by providing the sub door 200 with a plurality of transparent panels. Here, the plurality of transparent panels are provided in order to satisfy the thermal insulation requirement and to enable the inside to be visible from the outside.

However, since the weight of the sub door 200 itself is relatively increased, a problem may occur in that a hinge, which is adapted to allow the sub door 200 to be rotated thereabout, becomes deformed. In other words, since the sub door 200 may droop when it is used for an extended period of time, there may be a problem in that the sub door 200 is not normally fitted into the main door 100.

Technical Problem

Therefore, a fundamental object of the present invention is to solve the above problems occurring in the above-described refrigerators.

In an embodiment, the present invention intends to provide a refrigerator, in which a second door is easily opened to the maximum open angle, which exceeds 90 degrees in the state in which the second door is fitted into a first door to close of the first door.

In an embodiment, the present invention intends to provide a refrigerator, in which a second door is easily mounted on a first door.

In an embodiment, the present invention intends to provide a refrigerator, which is configured so as to limit the open angle of a second door and to efficiently attenuate impacts, which may be generated by a first door and the second door when the second door is opened to the maximum open angle, by means of a hinge.

In an embodiment, the present invention intends to provide a refrigerator, which is configured to reliably support a second door in a rotatable manner and to thus improve strength thereof even when the second door has an increased weight. In particular, the present invention intends to provide a refrigerator, which is capable of dispersing the vertical load of a second door at corners of the second door.

In an embodiment, the present invention intends to provide a refrigerator, in which a hinge of a second door is not exposed to the outside when the second door is closed. In addition, the present invention intends to provide a refrigerator, which is capable of minimizing the area of a second door that is exposed to a user even when the second door is open.

In an embodiment, the present invention intends to provide a refrigerator, which is capable of preventing cold air in the refrigerator from leaking out due to a hinge of a second door.

Technical Solution

In order to accomplish the above objects, in an embodiment, the present invention provides a refrigerator including a body defining a storage compartment therein, a first door hingedly provided at the body so as to open and close the storage compartment, the first door including a door frame having a hinge hole formed therein, and a second door hingedly provided at the first door by means of a hinge, the second door including a lateral side surface, the lateral side surface being at least partially fitted into the door frame, wherein the hinge includes a hinge shaft disposed in the first door so as to define the rotational center of the second door, a hinge bracket coupled to the second door, and an indented member provided between the hinge shaft and the hinge bracket, the indented member being moved through the hinge hole so as to allow the entire second door to escape from the door frame when the second door is opened.

When the second door is opened in the state in which the first door is closed, a user can access a sub storage compartment provided in the first door or the storage compartment.

The hinge bracket and the indented member may be configured to have horizontal surfaces, and a vertical stepped wall is provided between the hinge bracket and the indented member such that the hinge bracket and the indented member are positioned at different levels. The horizontal surface of the hinge bracket may contact the upper surface or the lower surface of the second door. Accordingly, the contact area between the hinge bracket and the second door may be increased. Similarly, the vertical stepped wall may be configured to contact the lateral side surface of the second door. Accordingly, the contact area between the vertical stepped wall and the second door may be increased, and the hinge and the second door may be coupled at a plurality of locations.

The hinge may include an upper hinge, the hinge bracket of which bracket is coupled to an upper surface of the second door, and a lower hinge, the hinge bracket of which is coupled to a lower surface of the second door.

The indented member of the upper hinge may be disposed at a position lower than the hinge bracket of the upper hinge due to the vertical stepped wall, and the indented member of the lower hinge may be disposed at a position higher than the hinge bracket of the lower hinge due to the vertical stepped wall.

Accordingly, the indented member of the upper hinge may be positioned lower than the upper surface of the second door, and the indented member of the lower hinge may be positioned higher than the lower surface of the second door.

The vertical stepped wall may be coupled to a lateral side surface of the second door, and each of the horizontal surface and the vertical stepped wall may have therein a fastening hole for coupling the hinge to the second door.

The indented member of the upper hinge may include a bent wall provided at an outer surface thereof, the bent wall being bent upward in a vertical direction from the outer surface. As a result, the geometrical moment of inertia may be increased.

The hinge hole may include an upper hinge hole into which the upper hinge is fitted, and a lower hinge hole into which the lower hinge is fitted, and the upper hinge hole may be positioned at a higher level than the lower hinge hole. As a result, the second door may be mounted on the first door after the hinge is first mounted on the second door. Specifically, the first door and the second door may be coupled to each other in such a manner as to dispose the second door at a level higher than the normal level, fit the hinges into the respective hinge holes, and move the second door downward.

Accordingly, after the second door is mounted on the first door, a relatively large gap may be defined in the lower hinge hole. In order to minimize the gap, a cover or a shielding plate may further be provided.

Specifically, the lower hinge hole may be provided with a cover for shielding the space remaining in the lower hinge hole, excluding the lower hinge, after the lower hinge is fitted into the lower hinge hole.

The indented member may include a first extension, extending from the hinge shaft in a direction away from the center of the second door in a lateral direction when the second door is closed, a second extension, extending rearward from the first extension, and a third extension, extending from the second extension in the direction of the second door.

The first door may include a hinge-accommodating portion for providing a space in which the indented member moves. The hinge shaft of the hinge may be held in the hinge-accommodating portion. Of course, the hinge shaft may be rotatably held. The hinge-accommodating portion may have defined therein a predetermined space, and may be isolated from another space in the first door, which is filled with a filler.

The indented member may include, on an outer surface thereof spanning between the second extension and the third extension, a first linear portion, parallel to the lateral side surface of the second door, and a first curved portion and a second linear portion, parallel to the front surface of the second door, the first linear portion, the first curved portion and the second linear portion being connected to each other.

At least one of the first linear portion, the first curved portion and the second linear portion may come into contact with the inner surface of the hinge-accommodating portion in a surface-contact manner when the second door is closed.

The indented member may include a second curved portion and a third curved portion, the second curved portion and the third curved portion having different radii of curvature and being connected to each other. Specifically, the second curved portion may have a larger radius of curvature than the third curved portion.

The hinge may include a stopper protruding parallel to the hinge shaft, the hinge stopper coming into contact with the inner surface of the hinge-accommodating portion near the hinge hole in a surface-contact manner when the second door is opened to the maximum extent.

The stopper may have a predetermined radius of rotation with respect to the hinge shaft of the hinge.

The stopper may include a surface-contacting portion, which is adapted to come into contact with the inner surface of the hinge-accommodating portion, and a reinforcing portion, which is bent away from the surface-contacting portion for increasing the rigidity of the surface-contacting portion. The surface-contacting portion may come into contact with the inner surface of the hinge-accommodating portion when the second door is opened to the maximum extent or is completely closed. Specifically, the outer surface of the surface-contacting portion may come into contact with the inner surface of the hinge-accommodating portion when the second door is opened to the maximum extent, and the inner surface of the surface-contacting portion may come into contact with the inner surface of the hinge-accommodating portion when the second door is completely closed.

The hinge-accommodating portion includes a metal reinforcing plate provided on the inner surface thereof, the metal reinforcing plate coming into direct contact with the stopper. In other words, the inner surface of the hinge-accommodating portion may be constituted by a metal reinforcing plate.

The door frame may include an internal front surface to which a gasket provided on the rear surface of the second door comes into close contact, and an internal side surface into which the lateral side surface of the second door is fitted, and the hinge hole may be formed in the internal side surface of the door frame. Accordingly, it is possible to prevent cold air from leaking due to the hinge.

The hinge bracket and the indented member may be integrally formed with each other, and the hinge shaft may be fitted into an end of the indented member.

The hinge may include a stopper fitted into the indented member at a location spaced apart from the hinge shaft by a predetermined distance, the stopper coming into contact with an inner surface of a hinge-accommodating portion, provided in the first door, in a surface-contact manner so as to limit a maximum open angle of the second door when the second door is opened to the maximum extent. The stopper may come into contact with the inner surface of the hinge-accommodating portion when the second door is completely closed.

In another embodiment, the present invention provides a refrigerator including a body defining a storage compartment therein, a first door hingedly provided at the body so as to open and close the storage compartment, the first door including a door frame having a hinge hole formed therein, a second door being fitted at the lateral side surface thereof into the door frame when the second door is closed, and escaping from the door frame when the second door is opened, and a hinge including a hinge shaft provided in the first door, a hinge bracket coupled to the second door and an indented member provided between the hinge shaft and the hinge bracket, the indented member being increasingly exposed from the hinge hole and enabling the entire lateral side surface of the second door to escape from the door frame when the second door is opened.

The door frame may include an internal side surface, the internal side surface being opposite to the lateral side surface of the second door when the second door is closed, and the internal side surface having a transverse width, the transverse width increasing forward. Specifically, the transverse width between the right internal side surface and the left internal side surface of the door frame may increase in a forward direction. Furthermore, the vertical height between the internal upper surface and the internal lower surface of the door frame may increase with increasing distance forward.

BEST MODE

Hereinafter, a refrigerator according to an embodiment of the present invention will be described in detail with reference to the accompanying drawings.

Figure 1:
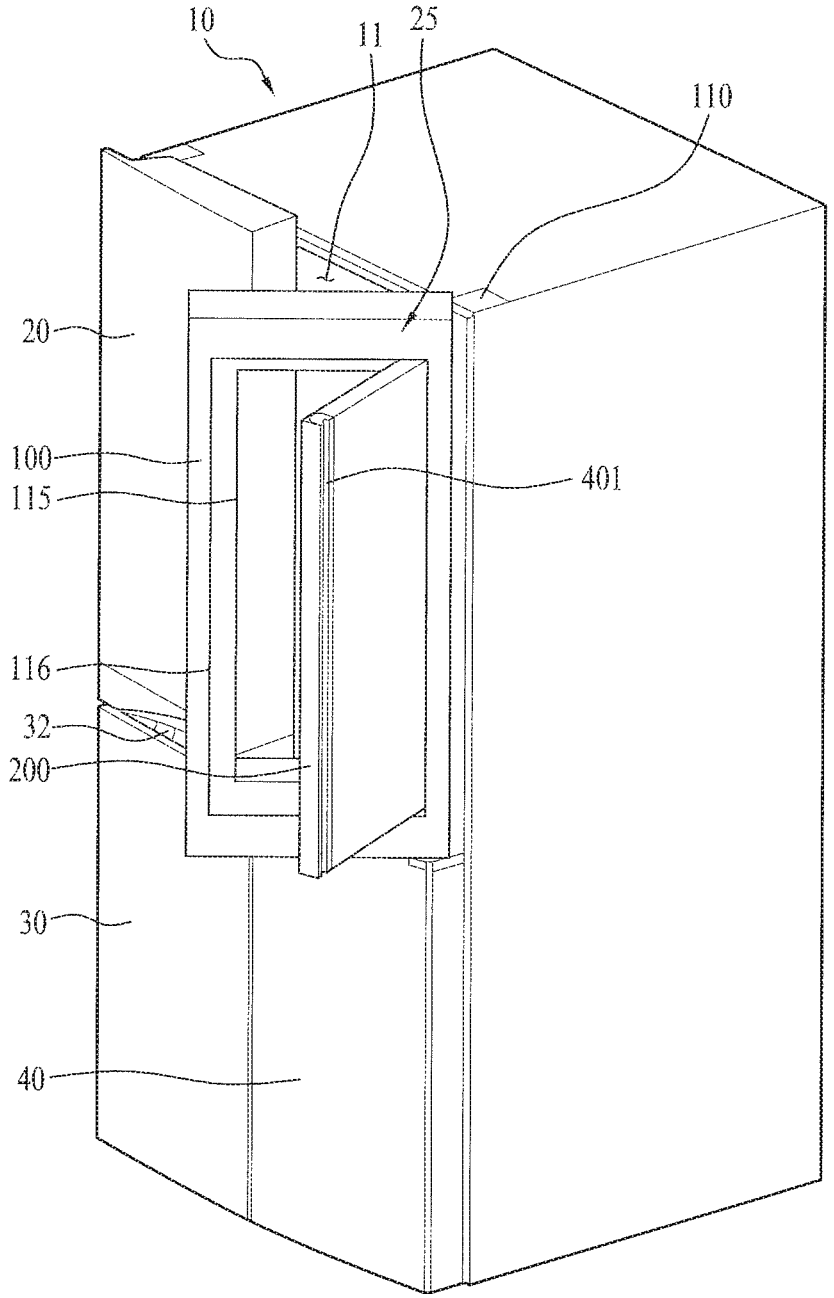
FIG. 1 is a perspective view illustrating an inside-type dual-door refrigerator disclosed in a related patent.

Since the principal features of this embodiment of the present invention pertain to the door and the hinge, the following description will be concentrated on them. The remaining components of the embodiment other than the door may be identical or similar to those illustrated with reference to FIG. 1.

The refrigerator and the door thereof, to which the embodiment of the present invention may be applied, are first described in detail with reference to FIGS. 2 and 3.

Figure 2:
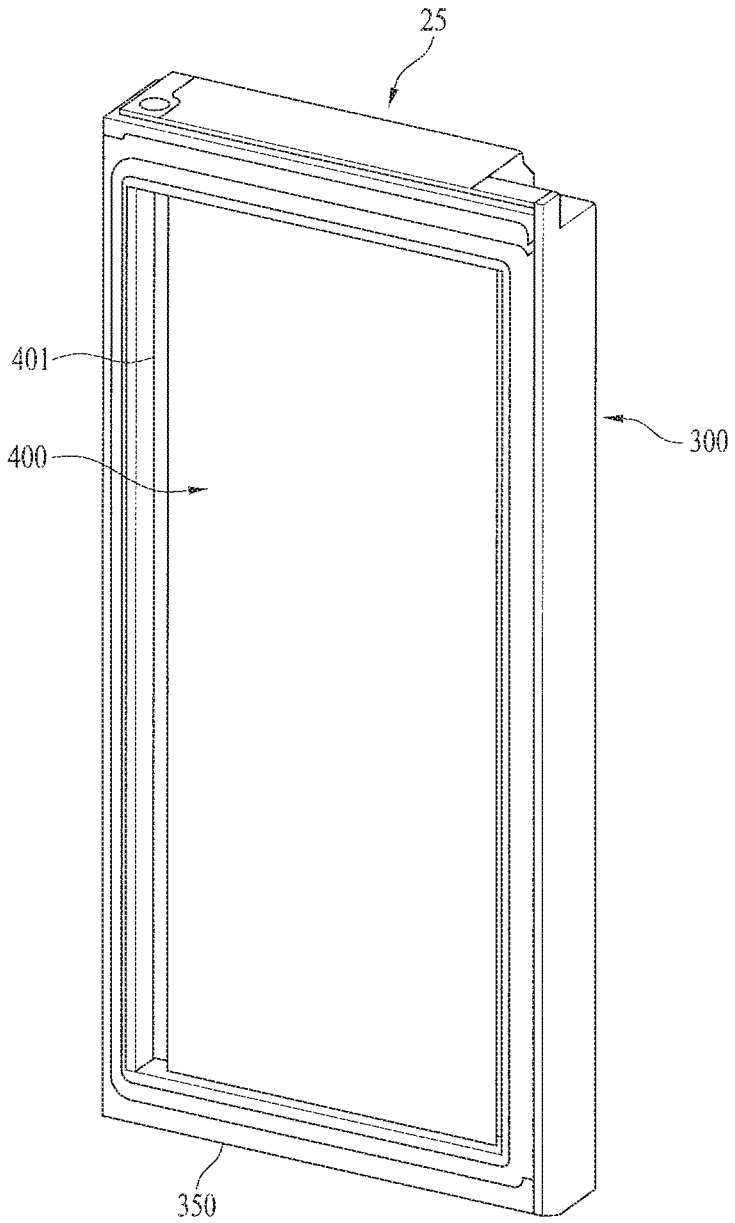
FIG. 2 is a perspective view illustrating a door of a refrigerator according to an embodiment of the present invention, in which a second door is fitted into a first door and is closed.

As illustrated in FIG. 2, the door 25 of the refrigerator includes a first door 300. The first door 300 may be a door adapted to open and close a refrigerating compartment or a freezing compartment. The door 25 of the refrigerator includes a second door 400. The second door 400 is configured to be hingedly coupled to the first door 300, and is in the state of being fitted in the first door 300 when it is closed.

A user may access the storage compartment by opening the first door 300. The first door 300 is provided with a first door handle 350 so as to enable a user to open or close the first door 300 while holding the first door handle 350 in his/her hand.

A user may access the storage compartment or the sub storage compartment by opening the second door 400. When a user accesses the storage compartment by opening the second door 400, the area of the storage compartment that can be accessed by the user may, of course, be restricted. Specifically, the entire internal space in the storage compartment can be easily accessed when the first door 300 is opened, but only part of the internal space in the storage compartment can be easily accessed when the second door 400 is opened.

The second door 400 is provided with a second handle 401 so as to allow a user to open or close the second door 400 while holding the second door handle 401 in his/her hand. The second door handle 401 may be provided separately from the first door handle 350. Accordingly, a user can separately open or close the first and second doors using the handles.

Figure 3:
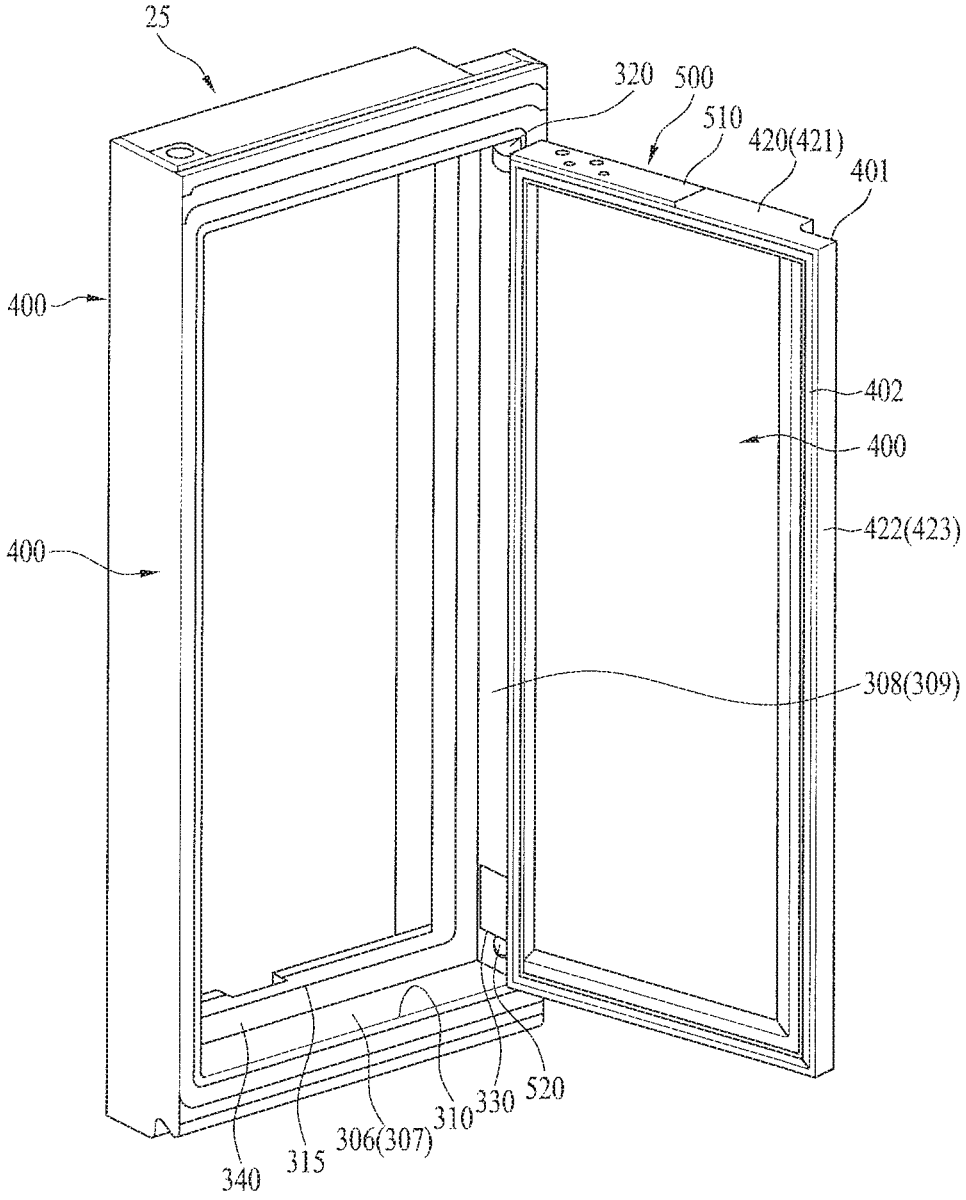
FIG. 3 is a perspective view illustrating the door shown in FIG. 2, in which the second door is opened from the first door.

As illustrated in FIG. 3, the second door 400 may completely escape from the first door 300 when opened. Specifically, when the second door 400 is opened to the maximum extent, the second door 400 may be completely separated from the first door 300. At this time, part of the hinge 500, which is adapted to connect the second door 400 to the first door 300, may still remain inside the first door 300, and the second door 400 may still be in the state of being connected to the first door 300 via the hinge 500. Accordingly, the second door 40 may be separated from the first door 300, and may be opened to an angle exceeding 90 degrees.

Specifically, the first door 300 includes a door frame 305. The door frame 305 may define the appearance of the door, and may serve as a frame into which the second door 400 is fitted.

The door frame 305 has a first opening 310, and a second opening 315, which is positioned inside the first opening 310. The first opening 310 may serve as a door opening in which the second door 400 is fitted, and the second opening 315 may serve as a passage opening, which allows a user to access the storage compartment while the second door 400 is open.

The door frame 305 includes an internal lower surface 306, an internal upper surface 307 and internal side surfaces 308 and 309, which are positioned at the rear side of the first opening 310. One of the internal surfaces may have hinge holes 320 and 330. When the rotating shaft of the second door 400 is provided on the right side of the first door 300, the hinge holes 320 and 330 may be formed in the internal right side surface 308, among the internal surfaces. The rotating shaft of the second door 400 may, of course, be provided on the left side of the first door 300. Hereinafter, the case in which the rotating shaft of the second door 400 is provided on the right side of the first door 300 will be described.

Similarly, the second door 400 includes a lower surface 421, an upper surface 420, a left surface 422 and a right surface 423, which correspond to the four internal surfaces 306, 307, 308 and 309 of the door frame 305. Accordingly, when the second door 400 is closed, all of the surfaces of the second door 400 are engaged with the door frame 305 and opposes the internal surfaces of the door frame 305. In contrast, when the second door 500 is completely opened, all the surfaces of the second door 400 may be separated from the door frame.

The hinge holes 320 and 330, which are formed in the internal surface of the door frame 305, for example, the internal right surface 308 of the door frame 305, are provided so as allow the hinge 500 to penetrate therethrough. Specifically, the hinge 500 penetrates the first door 300 through the hinge holes 320 and 330 and reaches the outside of the first door 300. Accordingly, one end of the hinge 500 may be positioned inside the first door 300, and the other end of the hinge 500 may be disposed outside the first door 300, and may be connected to the second door 300.

When the second door 400 is closed, the second door 400 must be sealably engaged with the first door 300. To this end, the second door 400 may be provided at the marginal portion of the rear surface thereof with a gasket 402. The door frame 305 may be provided with a close contact surface 340 for close contact with the gasket 402. The second opening 315 may be formed in an inside region of the close contact surface 340. Accordingly, even when the cold air inside the storage compartment collides with the second door 400, it is possible to prevent the cold air from leaking to the outside of the second door 400 by means of the gasket 402.

As described above, since the second door 400 includes a plurality of glass panels, the second door 400 may have a relatively heavy weight. This is because the second door 400 may be constituted by a plurality of glass panels, which are stacked with each other, in order to offer a predetermined thermal insulation capability. Accordingly, in order to offer reliable opening and closing operation of the second door 400, the hinge 500 may include an upper hinge 510 and a lower hinge 520. In other words, the second door 400 may be provided at upper and lower portions thereof with the upper hinge 510 and the lower hinge 520, respectively.

As will be described, the upper hinge 510 and the lower hinge 520 may have almost the same structure overall. However, there may be fine differences between the upper and lower hinges 510 and 520 due to the difference between the mounting positions thereof. The hinge hole may include the upper hinge hole 320 and the lower hinge hole 330 so as to correspond to the upper and lower hinges 510 and 520. In order to mount the second door 400 on the first door 300, the upper hinge hole 320 and the lower hinge hole 330 may be formed at different heights.

Figure 4:
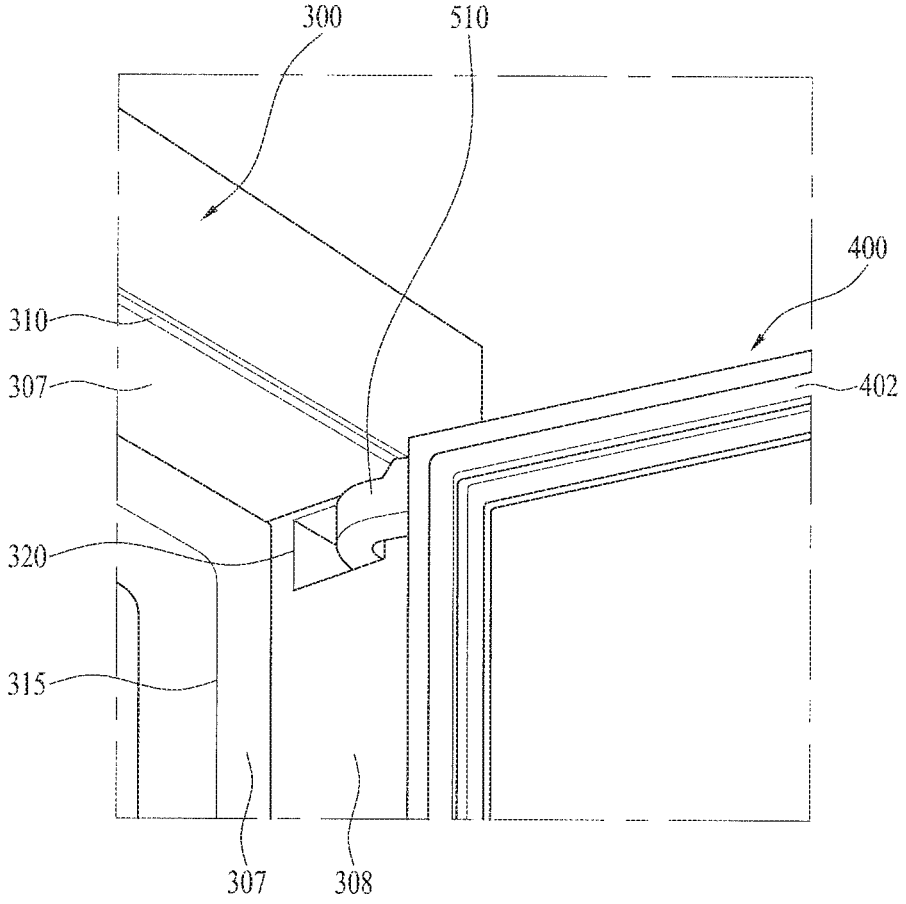
FIG. 4 is an enlarged perspective view illustrating the door shown in FIG. 3, in which the first door, the second door and an upper hinge are connected to each other.

FIG. 4 illustrates the upper hinge 510 and the upper hinge hole 320, which are disposed between the first door 300 and the second door 400. The upper hinge hole 320 is formed in the internal surface of the door frame 305. The hinge hole 320 has an anteroposterior width that is greater than that of the upper hinge 510, which is fitted into the upper hinge hole 320, and has a height that is higher than the upper hinge 510, which is fitted into the upper hinge hole 320.

As will be described later, as the second door 400 is rotated, the anteroposterior distance between the hinge 510 and the hinge hole 320 may vary. Accordingly, it is preferable to provide variation in the anteroposterior distance between the hinge 510 and the hinge hole 320 in order to prevent interference between the hinge and the hinge hole.

After the hinge 510 is mounted on the second door 400, the second door 400 may be coupled to the first door 300. Specifically, after the second door 400 is disposed at a position higher than the normal position, the hinge 510 is fitted into the hinge hole 320, and the second door 400 may then be lowered to the normal position. Accordingly, a gap may be defined between the lower end of the hinge hole 320 and the lower end of the hinge 510 during the installation of the second door 400, and a gap may be defined between the upper end of the hinge hole 320 and the upper end of the hinge 510 after completion of the installation of the second door 400. To this end, it is preferable for the hinge hole 320 to have a greater height than the hinge 510. Hence, it is preferable for the height of the hinge hole 320 to be substantially equal to or slightly larger than the height of the upper hinge 510 (i.e. the distance between the upper end of an indented member 513 (or horizontal wall) or a bent wall 516 and the lower end of a hinge shaft 514 or a stopper 515). This is because it is sufficient for only the indented member 513 and the hinge shaft 514 to be fitted into the hinge hole 320 during mounting of the second door 400, and because the upper hinge 510 is lowered after the second door 400 is mounted. Consequently, it is possible to minimize the gap between the upper end of the indented member 513 and the upper end of the hinge hole 510.

As illustrated in FIG. 4, it is appreciated that there is no interference between the hinge 510 and the gasket 402 or the close contact surface 340. This is because the hinge hole 320 is positioned outside the location at which the gasket 402 closely contacts the close contact surface 307. Accordingly, it is appreciated that the hinge 510 is positioned outside the gasket 402 when the second door 400 is closed. Since this means that cold air inside the gasket 402 is completely enclosed by the gasket 402, it is possible to minimize the leakage of cold air through the gap between the hinge 510 and the hinge hole 320.

Figure 5:
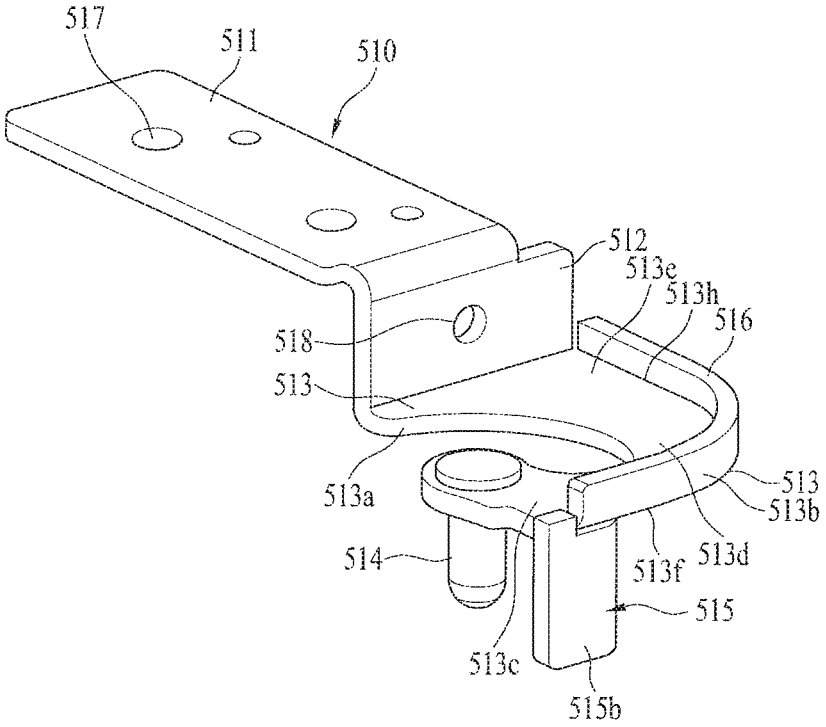
FIG. 5 is a perspective view illustrating the upper hinge.

Hereinafter, the upper hinge 510 will be described in detail with reference to FIG. 5. The hinge shaft 514 protrudes downward in the state in which the upper hinge 510 is mounted on the second door 400.

The upper hinge 510 may include the hinge shaft 514, which is disposed inside the first door 300 so as to define the rotational center of the second door 400, a hinge bracket 511 coupled to the second door 400, and the indented member 513 having a horizontal surface that is provided between the hinge shaft 514 and the hinge bracket 511.

The hinge bracket 511 is coupled to the second door 400 on the outer side of the first door 300. The indented member 513, which is a portion that is fitted into the hinge hole 320, is substantially entirely positioned inside the first door 300 when the second door 400 is closed. As the open angle of the second door 400 increases, the area of the indented member 513, which is exposed to the outside from the hinge hole 320, gradually increases.

Specifically, the hinge bracket 511 and the indented member 513 may be configured to have horizontal surfaces. A vertical stepped wall (or vertical wall) 512 may be formed between the hinge bracket 511 and the indented member 513. The hinge bracket 511 may be positioned at a higher level than the indented portion 513 by means of the vertical stepped wall 512.

In an example, the hinge bracket 511 is coupled to the upper surface 420 of the second door 400, as illustrated in FIG. 3. Specifically, the hinge bracket 511 is first disposed parallel to the upper surface 420, and is then coupled to the second door 400 via a fastening hole 517. The vertical stepped wall 512 may be coupled to the right side surface 423 of the second door 400 via a fastening hole 518. Accordingly, one hinge 510 may be coupled to both of the side surfaces 420 and 423 of the second door 400, which intersect each other. As a result, the hinge bracket 511 may be coupled to the second door 400 with a sufficient fastening force. In addition, since the hinge bracket 511 and the vertical stepped wall 512 surround the corner of the second door 400, the hinge 510 is able to more efficiently support the vertical load of the second door 400. This is because the vertical load of the second door 400 is applied not only to the hinge 510 but also to the corner portion of the second door 400 (the portion at which the upper surface and the right side surface of the second door 400 intersect each other). Accordingly, by virtue of the vertical stepped wall 512, the rigidity of the hinge 510 may be increased, and the load applied to the hinge 510 may be dispersed to the second door 400.

When the second door 400 is opened, the vertical load of the second door 400 is applied to the indented member 513 while the hinge shaft 514 is held in the first door 300. Accordingly, the indented member 513 may be considered to be similar to a cantilever to which the vertical load is applied. Although the distance between the hinge shaft 514 and the vertical stepped wall 512, that is, the distance of the moment, is relatively short, a very large vertical load may be applied to the indented member 513.

Referring to FIG. 3, a user may pull the second door 400 downward while holding the upper surface 420 of the second door 400 near the handle 401 in his/her hand. In this case, even though a small force is applied, the distance of the moment between the handle 401 and the hinge shaft 514 (i.e. the distance corresponding to the transverse width of the second door 400) is relatively large. Consequently, a very high moment may be applied to the indented member 513. Of course, such a very high moment may also be applied by the weight of the second door 400.

In order to more efficiently support the moment and to minimize deformation of the hinge 510, the hinge 510, particularly the outer surface of the indented member 513 is preferably provided with the bent wall 516. By virtue of the bent wall 516, it is possible to efficiently increase the geometrical moment of inertia attributable to the vertical load. This means that the rigidity, that is, the ability to withstand the vertical load, can be efficiently increased.

The hinge bracket 511, the vertical stepped wall 512 or the indented member 513 may be shaped by bending a single plate-shaped member. In other words, any of these components may be integrally formed. In addition, the bent wall 516 may also be integrally formed.

The hinge shaft 514 may be formed at the end of the bent wall 513 through push fitting or the like. Specifically, by forcibly fitting the pin-shaped hinge shaft 514 into the indented member 513, a hinge 510 that is completely formed in an integral manner may be prepared. Alternatively, the hinge shaft 514 may also be coupled to the indented member 513 through welding, or through a combination of push fitting and welding.

The hinge 510 may include the stopper 515. The stopper 515 may protrude from the indented member 513 in the direction parallel to the hinge shaft 514 so as to be spaced apart from the hinge shaft 514 by a predetermined distance. Accordingly, when the second door 400 rotates about the hinge shaft 514, the stopper 515 also rotates to the same angle. Of course, the stopper 515 is always positioned in the first door 300 within the range in which rotation of the second door 400 is allowed.

The stopper 515 may also be integrally formed with the other components of the hinge 510. In an example, the stopper 515 may be formed by being bent away from the indented member 513. In another example, similarly to the hinge shaft 515, the stopper 515 may be forcibly fitted into the indented member 513 so as to form a single integral hinge 510. Similarly, the stopper 515 may also be coupled to the indented member 513 through welding, or through a combination of push fitting and welding.

As described above, as the open angle of the second door 400 increases, the amount of the indented member 513 that projects from the hinge hole 320, also increases. In addition, interference between the indented member 513 and the hinge hole 320 must be prevented. In order to prevent such interference, the indented member 513 is provided between the hinge bracket 511 and the hinge shaft 514. Furthermore, the indented member 513 is intended to enable the second door 400 to completely escape from the first door 300 as the open angle of the second door 400 increases.

Figure 6:
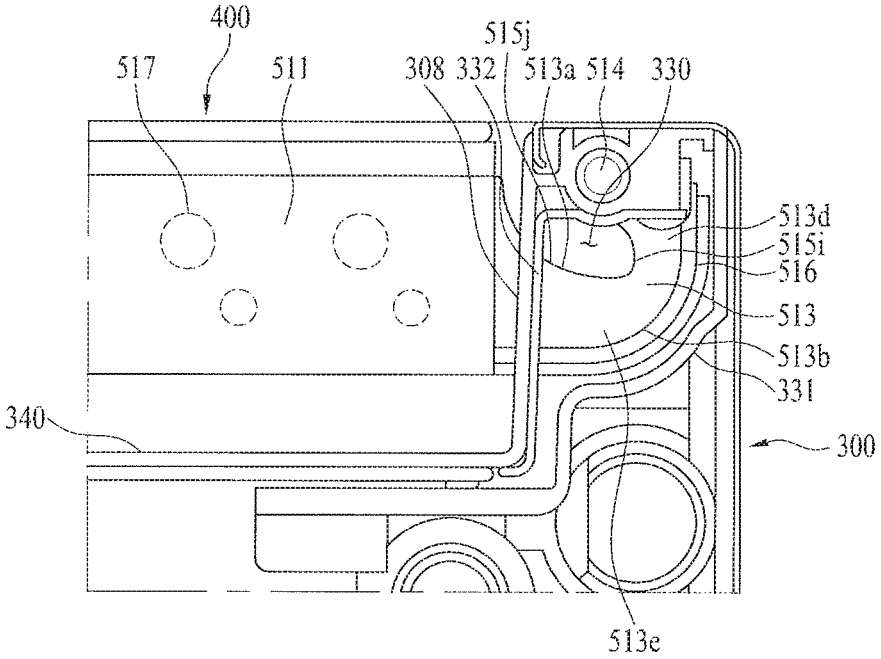
FIG. 6 is a plan cross-sectional view illustrating the upper hinge, viewed from below, when the second door is closed.
Figure 7:
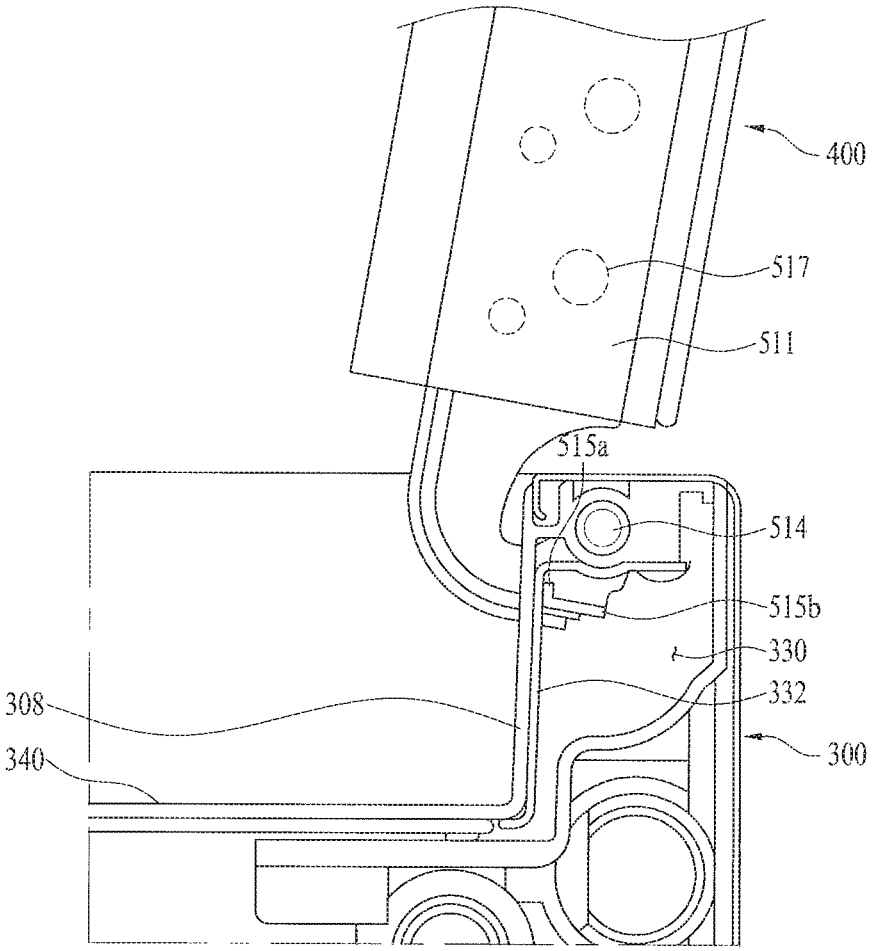
FIG. 7 is a plan cross-sectional view illustrating the upper hinge, viewed from below, when the second door is opened.

Hereinafter, the indented member 513 of the upper hinge 510 will be described with reference to FIGS. 6 and 7. FIGS. 6 and 7 are cross-sectional views, which respectively illustrate the state in which the second door 400 is closed and the state in which the second door 400 is opened to the maximum extent, when viewed from the bottom of the second door 400.

The first door 300 is provided therein with a hinge-accommodating portion 330. The hinge shaft 514 may be rotatably held in the hinge-accommodating portion. When the second door 400 is closed, most of the indented member 513 is positioned in the hinge-accommodating portion 330. The hinge-accommodating portion 330 provides a space that allows the indented member 513 to be moved therein when the second door 400 is opened.

The indented member 513 includes a first extension 513*c*, which extends from the hinge shaft 514 in the direction away from the center of the second door 400 in the lateral direction when the second door 400 is closed (in the rightward direction from the hinge shaft 514 in FIG. 6), a second extension 513*d*, which extends rearward from the first extension 513*c* (downward from the hinge shaft 514 in FIG. 6), and a third extension 513*e*, which extends from the second extension 513*d* in the direction of the second door 400 (in the leftward direction from the hinge shaft 514 in FIG. 6).

The outer surface 513*b* of the indented member 513 is constituted by a first linear portion 513*f*, a first curved portion 513*g* and a second linear portion 513*h*, which are connected to each other. Specifically, the first linear portion 513*f*, the first curved portion 513*g* and the second linear portion 513*h* may be formed on the outer surface of the indented member 513, which spans the second extension 513*d* and the third extension 513*e*.

At least one of the first linear portion 513*f*, the first curved portion 513*g* and the second linear portion 513*h* is preferably in contact with the inner surface 331 of the hinge-accommodating portion 330 in a surface-contact manner when the second door 400 is closed. Consequently, it is possible to attenuate impacts that may be transmitted between the hinge 510 and the hinge-accommodating port 330 at the time of complete closing of the second door 400.

The inner surface 513*a* of the indented member 513 may be provided with a second curved portion 515*i* and a third curved portion 515*j*, which are connected to each other. The second curved portion 515*i* and the third curved portion 515*j* preferably have different radii of curvature. Specifically, the second curved portion 515*i* may extend from the hinge shaft 514, and the third curved portion 515*j* may extend from the second curved portion 515*i*. The third curved portion 515*j* may be configured to have a predetermined radius starting from the hinge shaft 515.

As the second door 400 is opened, the third curved portion 515*j* escapes from the hinge hole 320 while rotating about the hinge shaft 514 along the orbit drawn by the predetermined radius. Accordingly, there is no interference between the hinge 510 and the hinge hole 320 by virtue of the provision of the third curved portion 515*j*.

As the second door 400 is further opened, the second door 400 may rotate to an angle exceeding 90 degrees. As illustrated in FIG. 6, the second curved portion 515*i* has a smaller radius of curvature than the third curved portion 515*j*, and is formed at a position far away from the center of the second door 400 in the lateral direction. Accordingly, as the second door 400 is opened to the maximum open angle, the second curved portion 515*i* escapes from the hinge hole 320 while rotating about the hinge shaft 514. Therefore, by virtue of the characteristic shape and radius of curvature of the second curved portion 515*i*, the interference between the hinge 510 and the hinge hole 320 may be eliminated. As a result, the second door 400 may be opened to a maximum angle that exceeds 90 degrees, particularly to an angle ranging from 100 to 120 degrees, in the state of having escaped from the door frame 305.

When the second door 400 is opened to the maximum angle, the stopper 515 of the second door 400 may come into contact with the inner surface 331 of the hinge-accommodating portion 330 in a surface-contact manner. In other words, the second door 400 may be opened until the stopper 515 comes into contact with the inner surface 331 of the hinge-accommodating portion 330, particularly the inner surface 331 near the hinge hole 320. In short, the stopper 515 may be considered to be a component that limits the open angle of the second door 400.

The hinge-accommodating portion 330 may be provided therein with a reinforcing plate 332 for reinforcing the inner surface 331 of the hinge-accommodating portion 330. Like the hinge 510, the reinforcing plate 332 may be made of metal. Since the stopper 515 comes into contact with the reinforcing plate 332 in a surface-contact manner, it is possible to improve the rigidity, durability and stability of the hinge 510. This is because excessive force may be applied between the hinge 510 and the hinge-accommodating portion 330 when a force for attempting to further open the second door 400 has been applied after the second door 400 is opened to the maximum extent. Accordingly, it is preferable to provide the reinforcing plate 332, and the stopper 515, adapted to come into contact with the reinforcing plate 332, in order to disperse and resist the excessive force.

Specifically, the stopper 515 may include a surface-contacting portion 515*a*, which comes into contact with the inner surface of the hinge-accommodating portion 330 or the reinforcing plate 332, and a reinforcing portion 515*b* for reinforcing the rigidity of the surface-contacting portion 515*a*. The reinforcing portion 515*b* may be formed in a direction substantially perpendicular to the surface-contacting portion 515*a*. More specifically, the reinforcing portion 515*b* may be configured to have a form bent away from the surface-contacting portion 515*a*. As described above, the stopper 515 may be secured to the indented member 513 through welding and/or push fitting.

Hereinafter, the lower hinge 530 will be described in detail.

Figure 8:
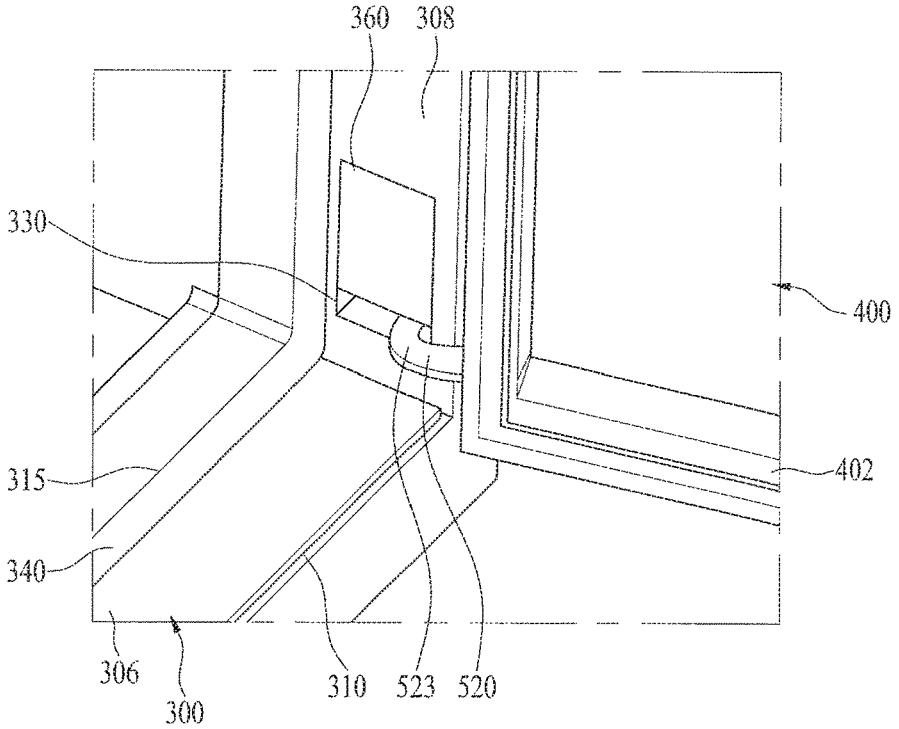
FIG. 8 is an enlarged perspective view illustrating the door shown in FIG. 3, in which the first door, the second door and a lower hinge are connected to each other.

FIG. 8 illustrates the lower hinge 520 and the lower hinge hole 330, which are provided between the first door 300 and the second door 400. The hinge hole 330 is formed in the inner surface 308 of the door frame 305, and has a greater anteroposterior width than the hinge 520, which is fitted into the hinge hole 330. Furthermore, the hinge hole 330 has a greater height than the hinge 520, which is fitted into the hinge hole 330.

As the second door 400 rotates, the anteroposterior distance between the hinge 520 and the hinge hole 330 may vary. Accordingly, it is preferable to provide variation in the anteroposterior distance between the hinge 520 and the hinge hole 330 in order to prevent interference between the hinge and the hinge hole.

After the hinge 520 is mounted on the second door 400, the second door 400 may be coupled to the first door 300. Specifically, after the second door 400 is disposed at a position higher than the normal position, the hinge 520 is fitted into the hinge hole 330, and the second door 400 may then be lowered to the normal position. Accordingly, a gap may be defined between the lower end of the hinge hole 330 and the lower end of the hinge 520 during the installation of the second door 400, and a gap may be defined between the upper end of the hinge hole 323 and the upper end of the hinge 520 after completion of the installation of the second door 400.

Figure 9:
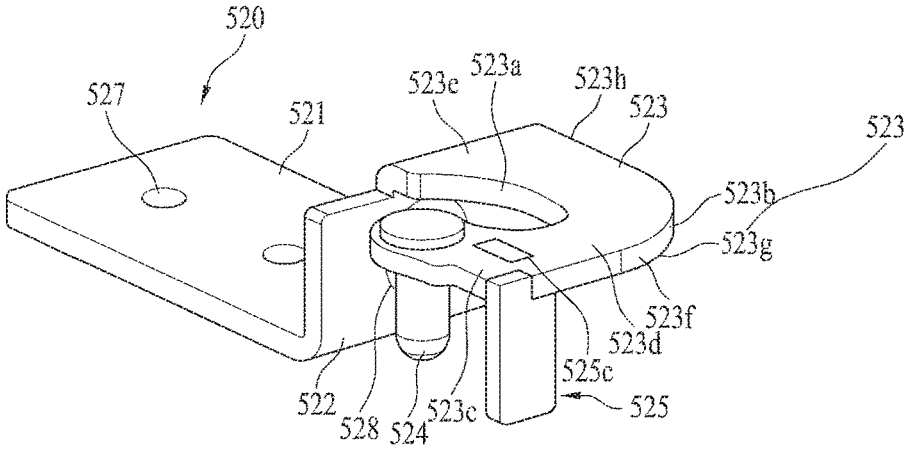
FIG. 9 is a perspective view illustrating the lower hinge.

The lower hinge hole 330 preferably has a greater height than the upper hinge hole 320. The height of the hinge hole 330 is preferably greater than the height of the lower hinge 520 (i.e. height between the upper surface of an indented member 523 or a bent wall 526 and the lower end of a hinge shaft 524 or a stopper 525), which is illustrated in FIG. 9. The reason for this is because the second door 4 must be disposed at a position that is higher than the normal position by a predetermined distance when the second door 400 is mounted on the first door 300. Accordingly, the height of the lower hinge hole 330 is preferably designed to be equal to or greater than the sum of the height of the hinge 520 and the predetermined distance. Accordingly, the gap between the indented member 523 of the lower hinge 520 and the upper end of the lower hinge hole 330 is greater than the gap between the indented member 513 of the upper hinge 510 and the upper hinge hole 320. This means that a relatively large gap is present in the lower hinge hole 330 after the second door 400 is mounted on the first door 300.

Since the level of the lower hinge hole 530 is similar to a user's eye level, the presence of the gap is problematic from the aspect of design. Furthermore, there may be a problem in that contaminants may enter the gap, considering the level of the user's hand.

Accordingly, the lower hinge hole 330 is preferably provided with a cover 360. By virtue of the cover 360, a gap, which is configured to have such a size as to receive only the hinge 520, is defined in the lower hinge hole 330. The cover 360 may be configured to be slidable vertically. Specifically, the cover 360 is slid upward when the second door 400 is mounted, and is slid downward so as to minimize the gap after mounting of the second door 400.

Referring to FIG. 8, it is appreciated that there is no interference between the hinge 520 and the gasket 402 or the close contact surface 340. This is because the hinge hole 330 is positioned outside the location at which the gasket 402 closely contacts the close contact surface 340. Accordingly, it is appreciated that the hinge 520 is positioned outside the gasket 402 when the second door 400 is closed. Since this means that cold air inside the gasket 402 is completely enclosed by the gasket 402, it is possible to minimize the leakage of cold air through the gap between the hinge 520 and the hinge hole 330.

Hereinafter, the lower hinge 520 will be described in detail with reference to FIG. 9. In the following description, descriptions of details of the lower hinge 520, which are identical or similar to those of the upper hinge 510, are omitted.

The hinge shaft 524 protrudes downward in the state in which the lower hinge 520 is mounted on the second door 400.

The lower hinge 520 may include the hinge shaft 524, which is disposed inside the first door 300 so as to define the rotational center of the second door 400, a hinge bracket 521 coupled to the second door 400, and the indented member 523, which is provided between the hinge shaft 524 and the hinge bracket 521.

The hinge bracket 521 is coupled to the second door 400 on the outer side of the first door 300. The indented member 523, which is a portion that is fitted into the hinge hole 330, is substantially entirely positioned inside the first door 300 when the second door 400 is closed. As the open angle of the second door 400 is increased, the area of the indented member 523, which is exposed to the outside from the hinge hole 330, gradually increases.

Specifically, the hinge bracket 521 and the indented member 523 may be configured to have horizontal surfaces. A vertical stepped wall 522 may be formed between the hinge bracket 521 and the indented member 523. As a result, the hinge bracket 521 is positioned at a lower level than the indented member 523 due to the vertical stepped wall 522. In contrast to the upper hinge 510, the indented member 523 is positioned at a higher level than the hinge bracket 521.

In an example, the hinge bracket 521 is coupled to the lower surface 421 of the second door 400, as illustrated in FIG. 3. Specifically, the hinge bracket 521 is first disposed parallel to the lower surface 421 of the second door 400, and is then coupled to the second door 400 via a fastening hole 527. The vertical stepped wall 522 may be coupled to the right side surface 423 of the second door 400 via a fastening hole 528. Accordingly, one hinge 520 may be coupled to both of the side surfaces 421 and 423 of the second door 400, which intersect each other. As a result, the hinge bracket 521 may be coupled to the second door 400 with sufficient fastening force. In addition, since the hinge bracket 521 and the vertical stepped wall 522 surround the corner of the second door 400, the hinge 520 is able to more efficiently support the vertical load of the second door 400. This is because the vertical load of the second door 400 is applied not only to the hinge 520 but also to the corner portion of the second door 400 (the portion at which the lower surface and the right side surface of the second door 400 intersect each other). Accordingly, by virtue of the vertical stepped wall 522, the rigidity of the hinge 520 may be increased, and the load applied to the hinge 5210 may be dispersed to the second door 400.

When the second door 400 is opened, the vertical load of the second door 400 is applied to the indented member 523 while the hinge shaft 524 is held in the first door 300. However, the moment applied to the lower hinge 520 is lower than the moment applied to the upper hinge 520. Accordingly, the lower hinge 520 may not be provided with the bent wall, unlike the upper hinge 510. As a result, it is possible to more reduce the gap defined in the lower hinge hole 330. For a similar reason, the number of fastening holes 527 in the hinge bracket 521 of the lower hinge 520 may be smaller than the number of fastening holes 517 in the hinge bracket 511 of the upper hinge 510.

Figure 10:
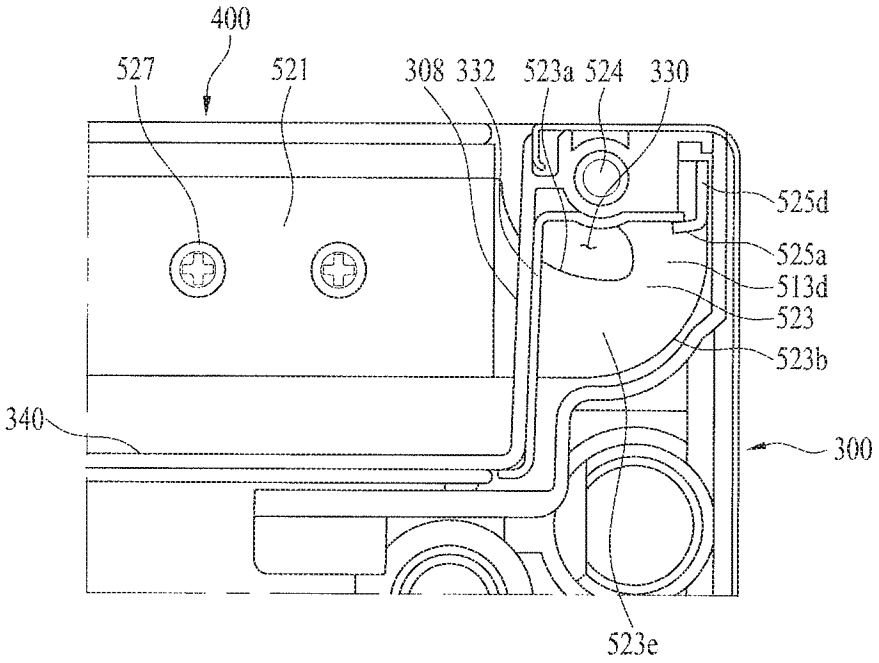
FIG. 10 is a plan cross-sectional view illustrating the lower hinge, viewed from below, when the second door is closed.
Figure 11:
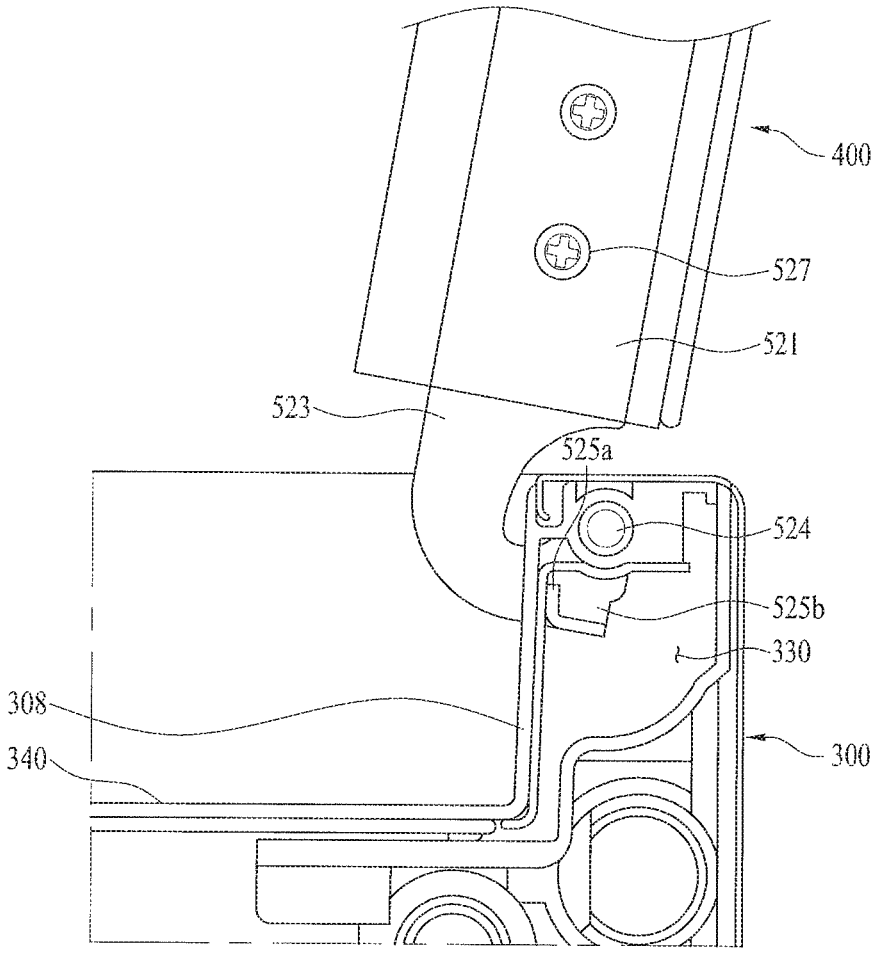
FIG. 11 is a plan cross-sectional view illustrating the lower hinge, viewed from below, when the second door is opened.

FIGS. 10 and 11 are cross-sectional views, which respectively illustrate the state in which the second door 400 is closed and the state in which the second door 400 is opened to the maximum extent, when viewed from the bottom of the second door 400. In other words, these drawings are illustrated from the viewpoint of the lower hinge 520.

As illustrated in FIGS. 9 to 11, the concrete features of the lower hinge 520 are identical or similar to those of the upper hinge 510. The reason for this is because the hinge shaft 524 of the lower hinge 520 must be aligned with the hinge shaft 514 of the upper hinge 510. In addition, the shape of the lower hinge 520, which is intended to prevent interference occurring between the hinge 520 and the hinge hole 330 during opening and closing of the second door 400, is also considered to be the same as that of the upper hinge 510.

As will be understood from FIGS. 9 to 11, reference numbers of the components of the lower hinge 520 are uniformly denoted by numeral "2" in the second digit thereof. Of course, reference numbers of the components of the upper hinge 510 are uniformly denoted by "1" in the second digit thereof. Accordingly, the components of the upper hinge 510 and the lower hinge 520, which have reference numbers which are different only in the second digit thereof, may be identical or similar to each other. Hence, redundant detailed descriptions thereof are omitted.

FIG. 9 illustrates a fitting hole 525*c* into which the stopper 525 may be fitted. Similarly, the upper hinge 510 may also be provided with the fitting hole.

Referring to FIGS. 4 and 8, it is appreciated that only the indented members 513 and 523 of the upper hinge 510 and the lower hinge 502 are visibly exposed to the outside when the second door 400 is opened, and that the upper and lower hinges 510 and 520 are completely hidden when the second door 400 is closed. Consequently, it is possible to improve the appearance of the door and the refrigerator by virtue of the hinge 500.

In addition, by virtue of the stoppers 515 and 525 provided at the hinge 500, it is possible to attenuate impacts, not only when the second door 400 is opened to the maximum open angle, but also when the second door 400 is completely closed.

As illustrated in FIG. 10, the surface-contacting portion 525*a* of the stopper 525 may be configured to come into contact with the reinforcing plate 332 in a surface-contact manner both when the second door 400 is opened to the maximum open angle and when the second door 400 is completely closed. Specifically, the surface-contacting portion 525*a* of the stopper 525 may come into contact at the outer surface thereof with the inner surface of the hinge-accommodating portion when the second door 400 is opened to the maximum open angle, and may come into contact at the inner surface thereof with the inner surface when the second door 400 is completely closed. Accordingly, even if the hinge 500 is used for a very extended period of time, there is no concern about damage or breakage of the second door 400 and the hinge 500.

According to an embodiment according to the present invention, only the indented member is visibly exposed to the outside when the second door 400 is opened, as illustrated in FIGS. 4 and 8. Accordingly, it is possible to offer a pleasant aesthetic appearance, and it is possible to improve the stability by minimizing the exposed area of moving components.

According to an embodiment of the present invention, the transverse width between the internal side surfaces 308 and 309 may be increased moving forward, as illustrated in FIGS. 6 and 10. Therefore, when the second door 400 is fitted into the internal side surfaces or is separated from the internal side surfaces, interference between the internal side surfaces and the external side surfaces 422 and 423 of the second door 400 is eliminated. In other words, since interference between the first door and the second door is eliminated, the second door may be very smoothly opened and closed.

| Description of Reference Numbers |
|---|
| 300: first door |
| 305: door frame |
| 320: upper hinge hole |
| 330: lower hinge hole |
| 400: second door |
| 402: gasket |
| 510: upper hinge |
| 511: upper hinge bracket |
| 512: vertical stepped wall of upper hinge |
| 513: indented member of upper hinge |
| 514: hinge shaft of upper hinge |
| 515: stopper of upper hinge |
| 520: lower hinge |
| 521: lower hinge bracket |
| 522: vertical stepped wall of lower hinge |
| 523: indented member of lower hinge |
| 524: hinge shaft of lower hinge |
| 525: stopper of lower hinge |

The invention claimed is:

1. A refrigerator comprising:

a body defining a storage compartment therein;

a first door coupled to the body so as to open or close the storage compartment, the first door including a door frame having an opening; and a second door configured to be rotatably coupled to the first door by a hinge so as to open or close the opening, the second door including one or more panels that are positioned in the opening when the second door closes the opening, wherein the hinge includes:

a hinge shaft received in the first door so as to define a rotational axis of the second door;

a horizontal wall to which the hinge shaft is connected;

a vertical wall extended from the horizontal wall in a first direction; and a hinge bracket extended from the vertical wall in a second direction that crosses the first direction and is coupled to the second door.

2. The refrigerator according to claim 1, wherein the door frame further includes internal surfaces to receive the second door, and wherein the opening of the door frame is provided between the internal surfaces and the storage compartment.

3. The refrigerator according to claim 2, wherein the internal surfaces include an internal lower surface, an internal upper surface and internal side surfaces, and a hinge hole into which the hinge shaft is configured to be inserted is provided on one of the internal side surfaces.

4. The refrigerator according to claim 2, wherein the door frame includes an internal vertical surface that is positioned to face a gasket positioned on an internal surface of the second door, and wherein the opening is provided between the internal vertical surface and the storage compartment.

5. The refrigerator according to claim 1, wherein the hinge is an upper hinge coupled to an upper surface of the second door, and the hinge bracket of the upper hinge is positioned higher than the horizontal wall of the upper hinge when coupled to the second door.

6. The refrigerator according to claim 5, wherein the hinge shaft of the upper hinge is extended downward from the horizontal wall of the upper hinge.

7. The refrigerator according to claim 5, wherein the hinge bracket of the upper hinge contacts the upper surface of the second door, and the vertical wall contacts a lateral side surface of the second door.

8. The refrigerator according to claim 7, wherein the hinge bracket of the upper hinge is coupled to the upper surface of the second door, and the vertical wall is coupled to the lateral side surface of the second door.

9. The refrigerator according to claim 8, wherein the hinge is coupled to the second door via fastening holes included in the hinge bracket and the vertical wall.

10. The refrigerator according to claim 1, wherein the hinge is a lower hinge, and the hinge bracket of the lower hinge is positioned lower than the horizontal wall of the lower hinge.

11. The refrigerator according to claim 10, wherein the hinge shaft of the lower hinge extends downward from the horizontal wall of the lower hinge.

12. The refrigerator according to claim 10, wherein the hinge bracket of the lower hinge contacts a lower surface of the second door, and the vertical wall contacts with a lateral side surface of the second door.

13. The refrigerator according to claim 12, wherein the hinge bracket of the lower hinge is coupled to the lower surface of the second door, and the vertical stepped wall is coupled to the lateral side surface of the second door.

14. The refrigerator according to claim 13, wherein the lower hinge is coupled to the second door via fastening holes included in the hinge bracket and the vertical wall.

15. The refrigerator according to claim 1, wherein the hinge further includes:

a first extension attached to the horizontal wall and extending from the hinge shaft in a lateral direction away from a center of the second door when the second door is closed;

a second extension attached to the horizontal wall and extending rearward from the first extension; and a third extension attached to the horizontal wall and extending from the second extension and toward the second door.

16. The refrigerator according to claim 15, wherein the first door includes a space that receives the hinge shaft and in which the horizontal wall moves when the second door rotates to close the opening.

17. The refrigerator according to claim 16, wherein the horizontal wall includes, at an outer surface thereof spanning between the second extension and the third extension, a first linear region that is positioned parallel to a lateral side surface of the second door, a first curved region, and a second linear region that is positioned parallel to a front surface of the second door, the first linear region, the first curved region and the second linear region being connected to each other.

18. The refrigerator according to claim 17, wherein at least one of the first linear region, the first curved region, or the second linear region comes into contact with an inner surface of the space of the first door when the second door is rotated to close the opening.

19. The refrigerator according to claim 17, wherein the horizontal wall includes a second curved region and a third curved region, the second curved region and the third curved region having different radii of curvature and being connected to each other, and wherein the radius of curvature of the second curved region is larger than the radius of curvature of the third curved region.

20. The refrigerator according to claim 1, wherein the hinge bracket and the horizontal wall are integrally formed with each other, and the hinge shaft is fitted into an end of the horizontal wall.

* * * * *